US005613329A

United States Patent [19]

Land et al.

[11] Patent Number: 5,613,329

[45] Date of Patent: Mar. 25, 1997

[54] GROUND ANCHOR

[75] Inventors: Nicholas F. Land, Suffolk; Michael E. Smith, Southampton, both of England

[73] Assignee: Terra-Lock Systems Limited, United Kingdom

[21] Appl. No.: 464,862

[22] PCT Filed: Jan. 13, 1994

[86] PCT No.: PCT/GB94/00072

§ 371 Date: Sep. 13, 1995

§ 102(e) Date: Sep. 13, 1995

[87] PCT Pub. No.: WO94/16177

PCT Pub. Date: Jul. 21, 1994

[30] Foreign Application Priority Data

Jan. 15, 1993 [GB] United Kingdom ..... 9300674

[51] Int. Cl.[6] ..... E02D 5/80

[52] U.S. Cl. ..... 52/157; 52/156; 52/165; 52/705

[58] Field of Search ..... 52/156, 157, 165, 52/298, 705, DIG. 11; 256/DIG. 5

[56] References Cited

U.S. PATENT DOCUMENTS

| | | | |
|---|---|---|---|
| 200,946 | 3/1878 | Sprout | 256/DIG. 5 X |
| 235,709 | 12/1880 | Smith et al. | 52/156 |
| 906,438 | 12/1908 | Lemerand | 52/157 |
| 3,011,597 | 12/1961 | Galloway et al. | 52/156 |
| 3,724,145 | 4/1973 | Daniel | 52/157 |
| 4,162,789 | 7/1979 | Hollaway | 52/157 X |

*Primary Examiner*—Christopher T. Kent
*Attorney, Agent, or Firm*—Charles D. Gunter, Jr.

[57] ABSTRACT

A ground anchor is shown for use in anchoring and supporting posts or other structures in the ground. The ground anchor includes a tubular socket and a twisted flat bar. The socket is provided with a structure to prevent rotation and has a diametral slot provided in a bottom closure of the socket. The socket is inserted into the ground by driving the bar into the ground, via the slot, so that it rotates and follows a helical path as dictated by the twist of the bar.

7 Claims, 2 Drawing Sheets

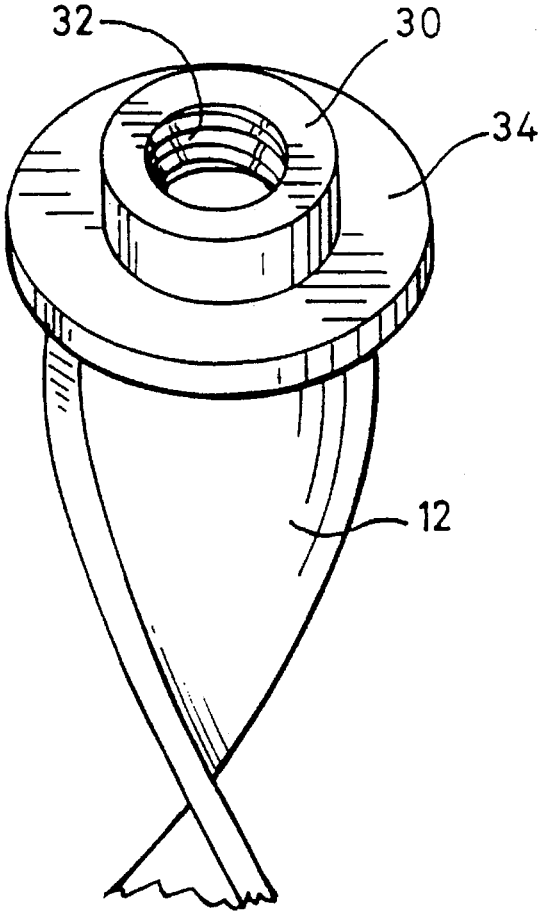
Fig. 3
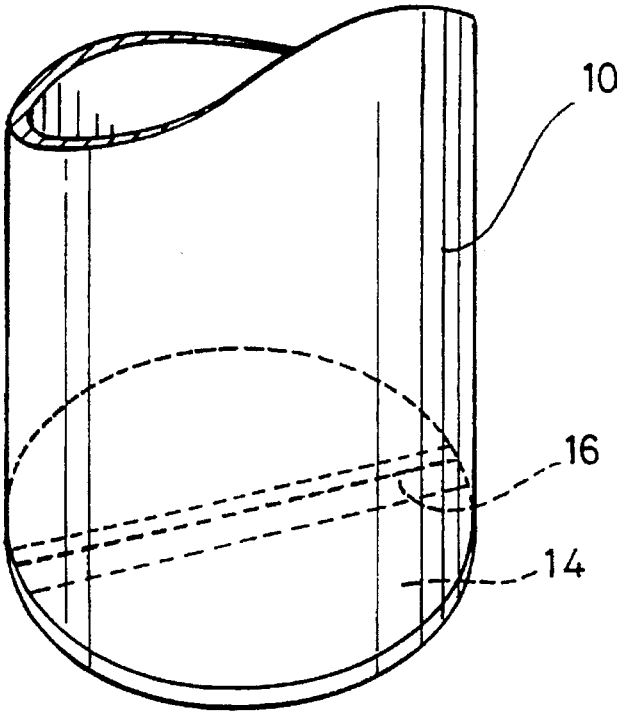

GROUND ANCHOR

BACKGROUND OF THE INVENTION

1. Field of the Invention

This invention relates to a ground anchor for use in anchoring structures either in or to the ground.

2. Description of the Prior Art

Ground anchors are used in particular to anchor and support posts in the ground, but can also have other uses. For example a ground anchor can be used to anchor a park bench or a light weight building such as a garden shed to the ground. It is often important to ensure that the ground anchor should resist unauthorised removal from the ground.

SUMMARY OF THE INVENTION

According to the present invention there is provided a ground anchor comprising a tubular socket with a closed bottom, the socket being intended to be inserted in the ground, means for preventing rotation of the socket in the ground, a diametral slot in the closed bottom of the socket, and a twisted flat bar adapted to pass along the socket and through the slot.

The tubular socket may be adapted to receive a tubular member to be anchored. Alternatively the tubular socket may carry a flange as its upper surface to which a bracket or other attachment member can be fastened.

Rotation of the socket in the ground may be prevented by radially extending wings mounted on the outside of the socket. Alternatively the socket may be of a non-round shape to prevent rotation.

In order to further stabilise the socket in the ground, hinged lock members can be pivoted around the periphery of the socket, with the lock members being rotated into the ground once the socket has been inserted in the ground. The lock members preferably have a surface which extends in a direction tangential to the axis of the socket.

The twisted bar is preferably sharpened or pointed at one end and has a driving head at the other end. The driving head preferably included a flange which will not pass through the diametral slot, and a threaded socket which can be engaged from within the tubular socket to withdraw the flat bar.

The tubular socket and the flat bar may be sold separately.

BRIEF DESCRIPTION OF THE DRAWINGS

The invention will now be further described, by way of example, with reference to the accompanying drawings, in which:

FIG. 3 is an enlarged view of part of the twisted bar of the ground anchor of the invention;

DETAILED DESCRIPTION OF THE INVENTION

Figures 1, 2, 2A:
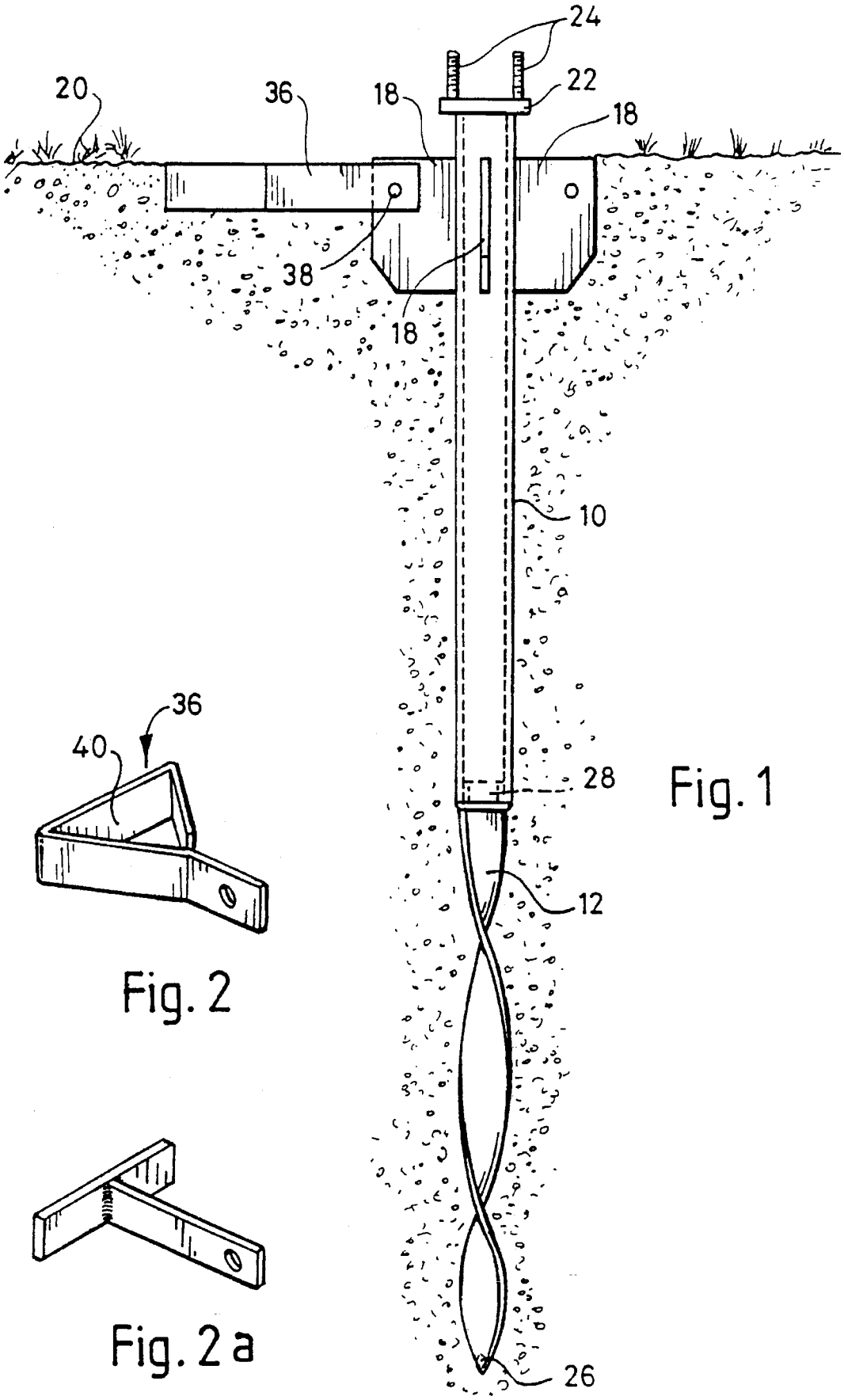
FIG. 1 shows a ground anchor in accordance with the invention inserted in the ground.
FIG. 2 is a perspective view of a lock member used with the ground anchor of FIG. 1.
FIG. 2*a* is another form of lock member which can be used with the ground anchor.

The anchor has two separate parts. The first part is a tubular socket 10, and the second part is a twisted flat bar 12. The tubular socket 10 is closed at the bottom by a flat plate

14 (FIG. 3) which has a diametral slot 16 formed through it. At the top of the socket 10 radial wings 18 are welded to the external surface and, as can be seen in FIG. 1, when the socket 10 is buried in the ground the wings 18 prevent rotation of the socket. They also contribute to the stability of the socket in that they resist any movement in the plane of the ground surface 20.

At the top end the socket 10 has a flange 22. FIG. 1 shows threaded studs 24 extending upward from the flange 22 so that an item to be anchored can be connected to the flange. FIG. 1 shows the flange above ground level but it may equally be possible to insert the socket 10 into the ground so that the flange 22 lies at ground level.

As an alternative to the attachment of the article to be anchored by the studs 24 and the flange 22, the internal bore of the socket 10 may provide the support for, for example, a post which can be dropped into the socket.

In order to anchor the socket 10 in the ground and to resist axial pull-out forces, the bar 12 is used.

In use, the socket 10 will first be inserted fully into the ground to the position shown in FIG. 1. An auger or the like can be used to prepare a hole for the socket. Next the bar 12 is inserted into the centre of the socket, and the width of the bar is such that it will be a clearance fit inside the socket. The bar has a sharpened leading end 26, and when the bar is fully within the socket the bar is rotated until the plane of the bar at the tip 26 passes through the slot 16. The bar is then driven down into the ground passing through the slot 16 and following a helical path as dictated by the twist in the bar. It will be appreciated that the bar will rotate as it is driven down and that the ground will only be disturbed along a flat helical path through the ground. Once the top end 28 of the bar enters the internal bore of the socket 10, the necessary driving force will be applied to the head of the bar by a dolly of suitable length and diameter.

Once the anchor is fully inserted in the position shown in FIG. 1, it will be impossible to pull the anchor out in an axial direction without having to displace a complete cylindrical column of ground in the area where the twisted bar 12 lies.

It is appreciated that it may become necessary to remove the socket intentionally, and to enable this to take place the top of the bar 12 carries a collar 30 with an internal tapped bore 32. To withdraw the bar a suitable dimensioned rod with a threaded end is inserted down the socket 10 and is screwed into the collar 30. The bar can then be lifted and rotated so that it rises up into the socket 10, through the slot 12 in the opposite manner to that in which it was driven down. The surface of the bar 12 will then follow the same helical path along which it was driven into the ground.

The top of the bar 12 also carries a disc 34 to limit the downward movement of the bar and to prevent the bar passing entirely through and becoming disconnected from the slot 16.

In order to increase the restraining effect of the wings 18, locking member 36 can be pivoted to the wings at 38. When the socket 10 is driven into the ground, the locking members will be in a raised position, lying generally parallel to the socket 10. However once the socket is fully home the locking members can be swung downwards and forced into the ground so that they provide additional resistance to movement of the top of the socket in the place of the ground surface 20. FIGS. 2 and 2*a* show two suitable forms of locking member. The locking member of FIG. 2 is formed of bent bar material with a limb 40 at right angles to the wing 18 to which it is connected. The locking member of FIG. 2*a* is formed of two lengths of bar welded together to form a T-shape.

The ground anchor described is simple to manufacture and yet provides a strong and effective anchorage point in the ground.

We claim:

1. A ground anchor comprising a tubular socket with a closed bottom, the tubular socket being intended to be inserted in the ground, means for preventing rotation of the tubular socket in the ground, a diametral slot in the closed bottom of the tubular socket, and a twisted flat bar adapted to pass along the tubular socket and through the slot.

2. A ground anchor as claimed in claim 1, wherein the tubular socket is adapted to receive a tubular member to be anchored.

3. A ground anchor as claimed in claim 1, wherein the tubular socket carries a flange at an upper surface to which a bracket or other attachment member may be fastened.

4. A ground anchor as claimed in claim 1, wherein rotation of the tubular socket in the ground is prevented by radially extending wings mounted on the outside of the tubular socket.

5. A ground anchor as claimed in claim 1, wherein hinged lock members are pivoted around the periphery of the tubular socket, the lock members being rotatable to engage with the ground once the tubular socket has been inserted in the ground.

6. A ground anchor as claimed in claim 1, wherein the twisted bar is sharpened or pointed at one end and has a driving head at the other end.

7. A ground anchor as claimed in claim 6, wherein the driving head includes a flange which will not pass through the diametral slot, and a threaded socket which can be engaged from within the tubular socket to withdraw the bar.

* * * * *